United States Patent [19]

Tanaka

[11] 4,408,105

[45] Oct. 4, 1983

[54] SEESAW SWITCH

[75] Inventor: Toshio Tanaka, Furukawa, Japan

[73] Assignee: Alps Electric Co., Ltd., Japan

[21] Appl. No.: 323,033

[22] Filed: Nov. 19, 1981

[30] Foreign Application Priority Data

Nov. 19, 1980 [JP] Japan ..... 55-166013

[51] Int. Cl.[3] ..... H01H 1/22; H01H 5/08

[52] U.S. Cl. ..... 200/68; 200/6 BA; 200/244

[58] Field of Search ..... 200/67 G, 68, 244, 238, 200/6 BA, 6 R

[56] References Cited

U.S. PATENT DOCUMENTS

| | | | |
|---|---|---|---|
| 3,581,033 | 5/1971 | Plumb | 200/67 G |
| 3,746,809 | 7/1973 | Gaber | 200/67 G |
| 3,852,557 | 12/1974 | Brown | 200/67 G |
| 3,935,411 | 1/1976 | Ford | 200/67 G |

FOREIGN PATENT DOCUMENTS

| | | |
|---|---|---|
| 828875 | 2/1960 | United Kingdom . |
| 1148791 | 4/1969 | United Kingdom . |
| 1280945 | 7/1972 | United Kingdom . |
| 1308393 | 2/1973 | United Kingdom . |

*Primary Examiner*—John W. Shepperd

*Attorney, Agent, or Firm*—Guy W. Shoup; Gerard F. Dunne

[57] ABSTRACT

In a seesaw switch having a central terminal, stationary terminals disposed on respective sides of the central terminal, and a movable contact piece placed over the central terminal, the movable contact piece being rocked so as to connect or disconnect the central terminal and the corresponding stationary terminal, the improvement comprising the fact that a receiver for the movable contact piece is provided with an arcuate guide portion interposed between said movable contact piece and said middle terminal for supporting said movable contact piece in a turnable fashion.

5 Claims, 6 Drawing Figures

SEESAW SWITCH

BACKGROUND OF THE INVENTION

The present invention relates to seesaw switches, and more particularly to the contact structure of such a switch wherein the movable contact piece is securely held in place and yet it can move smoothly between its various positions.

Seesaw switches are, of course, known and are typically used to switch power in industrial devices and audio equipment, and the like.

FIG. 1 is an explanatory view of the contact structure of a known seesaw switch. In the figure, numeral 11 designates a casing and a receiver 14 having a U-shaped section is fixed to the bottom surface 11*a* of the casing. The receiver 14 is adapted to hold a movable contact piece 16 for rocking movement between two stationary terminals 15 each having a stationary contact 15*a* and disposed on respective sides of the casing. The receiver 14 is fixed to a middle terminal 12 by a rivet 13 and movable contacts 16*a* are provided at respective ends of the movable contact piece 16, which is formed substantially in the shape of the letter V. Numeral 17 indicates a driving rod which is disposed so as to come into sliding contact with the facing surface 16*b* of the movable contact piece 16, and which is received through a coiled spring 18 in a hole provided in a driving member, not shown, rockably supported by the casing 11. The movable contact piece 16 is held to the receiver 14 in a manner allowing it to be rocked in the direction of arrows by the protuberant pieces 14*a* formed at the upper ends of the receiver 14 and held in engagement with slots 16*c* provided centrally of the contact piece 16.

The switching operation of such switches is carried out as stated below. In the initial state, i.e. neutral position, the fore end of the driving rod 17 lies over the center of the middle terminal 12 and is in resilient contact with the upper surface 16*b* of the movable contact piece 16. The movable contact piece 16 is supported at two points by the receiver 14. Therefore, the movable contacts 16*a* on respective sides of the contact piece are equally distant from the respectively corresponding stationary contacts 15*a*, and the switching circuit is open. When the driving member is rocked from its neutral position, the driving rod 17 begins to move rightward of leftward from its central position. When the fore end of the driving rod 17 passes over one free end 14*b* of the receiver 14, the movable contact piece 16 is instantly and suddenly inclined about the fulcrum formed by the free end 14*b* by the resilient force of the coiled spring 18. Thus, a movable contact 16*a* is moved into engagement with a stationary contact 15*a*, and the switching circuit is closed.

In such seesaw switches, the movable contact piece 16 is held to the receiver 14 by the protuberant pieces 14*a* of the receiver 14 being fitted within the slots 16*c*. This has led to the disadvantage that, upon the sudden inclination of one side of the movable contact piece 16, the other side tends to rise due to the impact, with the result that the slots 16*c* of that other side may rise out of engagement with the protuberant pieces 14*a*. In order to prevent the movable contact piece 16 from lifting off the receiver 14, the height of the protuberant pieces 14*a* of the receiver 14 have been increased. With this method, however, the width of the slots 16*c* must be broadended so as not to hinder the turning of the movable contact piece 16. The enlarged width increases the play of the movable contact piece 16 in the longitudinal direction thereof. This play has led to the disadvantage that the movable contact 16*a* undergoes a positional deviation relative the stationary contact 15*a* and that the contacts do not touch normally in an extreme case, especially when the switch is used with higher voltage and thus the contact gaps are large, so the performance becomes unstable.

SUMMARY OF THE INVENTION

Accordingly, the present invention has for its object to provide a seesaw switch in which the movable contact piece is held in place even when it has inclined for a switchin operation, and which can perform stable switching without becoming loose or unstable.

The present invention for accomplishing the object consists in a seesaw switch having a central terminal, stationary terminals disposed on respective sides of the central terminal, and a movable contact piece placed over the central terminal, the movable contact piece being rockable so as to connect or disconnect the central terminal and a corresponding stationary terminal characterized in that a receiver for the movable contact piece is provided with an arcuate guide portion interposed between said movable contact piece and said middle terminal for supporting said movable contact piece in a turnable fashion.

BRIEF DESCRIPTION OF THE DRAWINGS

FIGS. 2 to 4 are explanatory views of a seesaw switch according to the present invention, in which FIG. 2 is a view of the contact structure of the seesaw switch, FIG. 3 is an exploded perspective view of the essential portions thereof, and FIG. 4 is a view for explaining the operation thereof, and FIGS. 5 and 6 are explanatory views of another embodiment of the seesaw switch according to the present invention, in which FIG. 5 is a view of the contact structure of the embodiment, and FIG. 6 is an exploded perspective view of the essential portions thereof.

PREFERRED EMBODIMENTS OF THE INVENTION

Hereunder, embodiments of the present invention will be described in detail with reference to the drawings.

Figure 2:
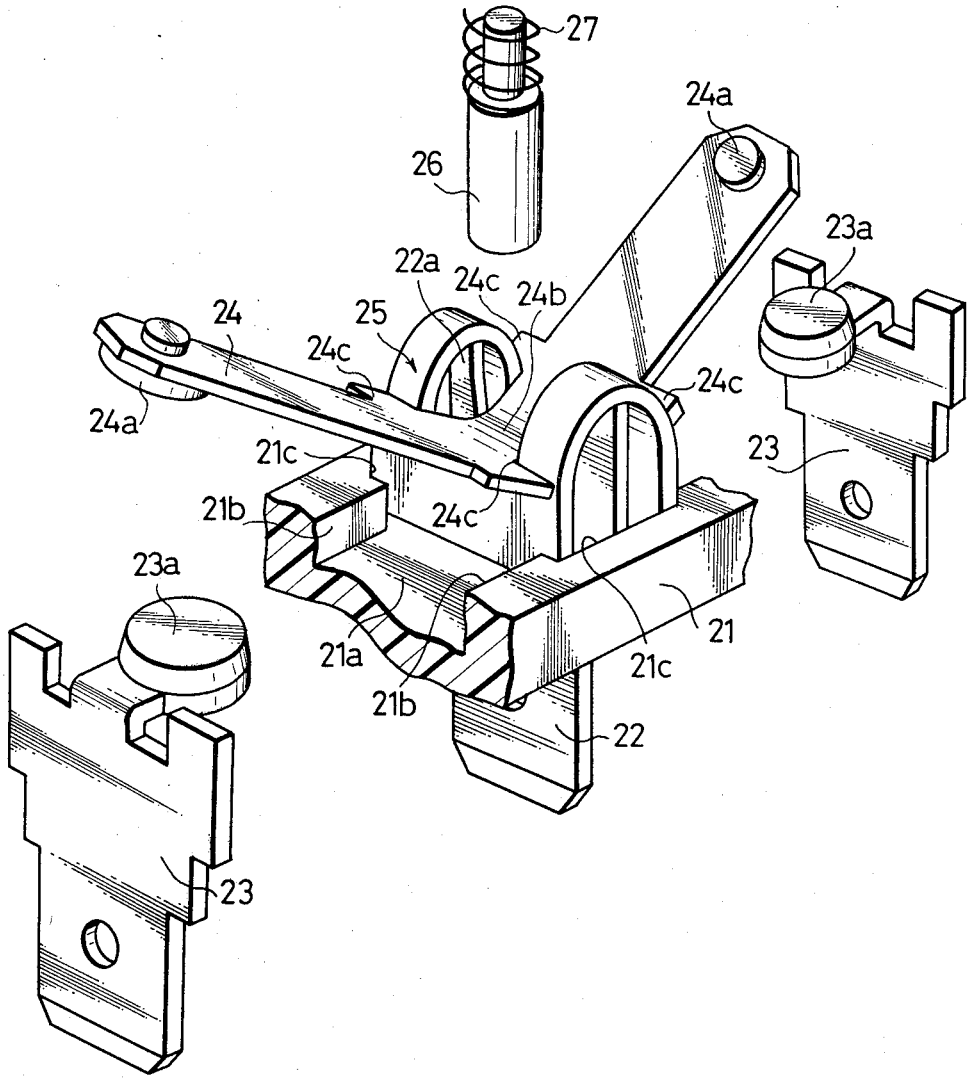
Figure 3:
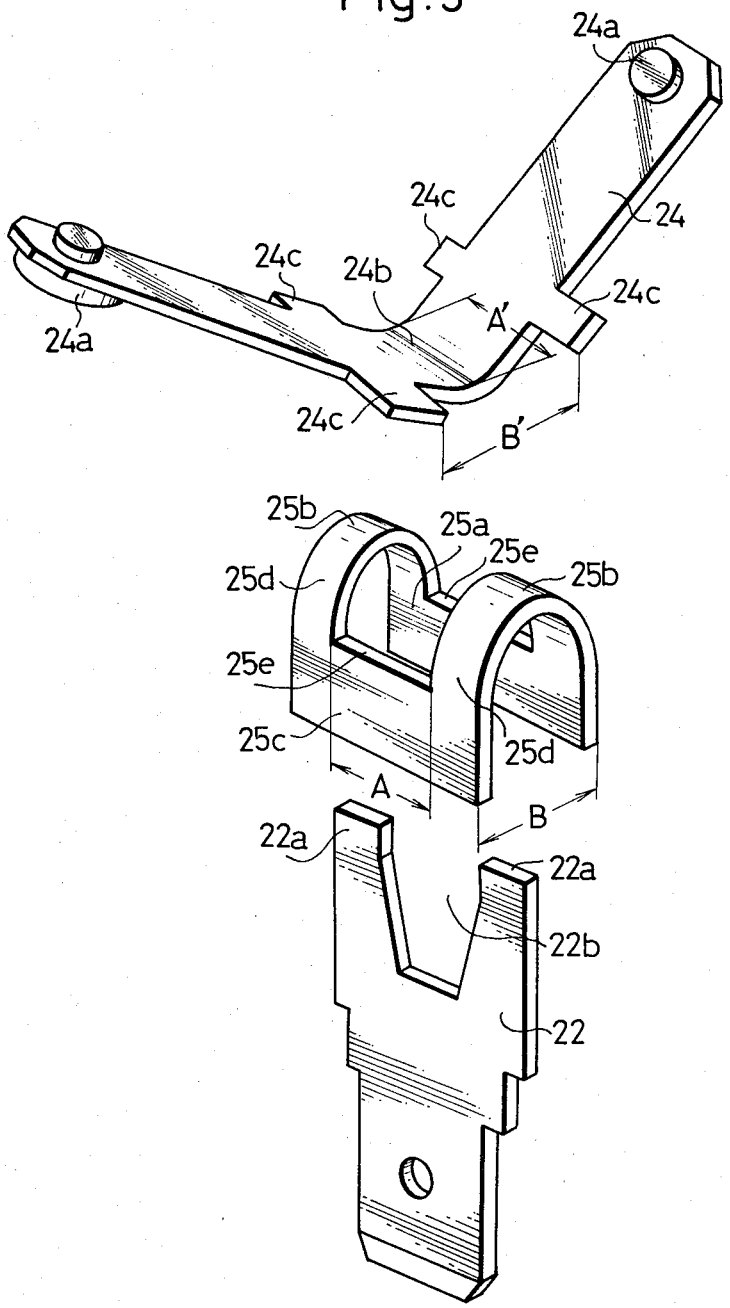
Figure 4:
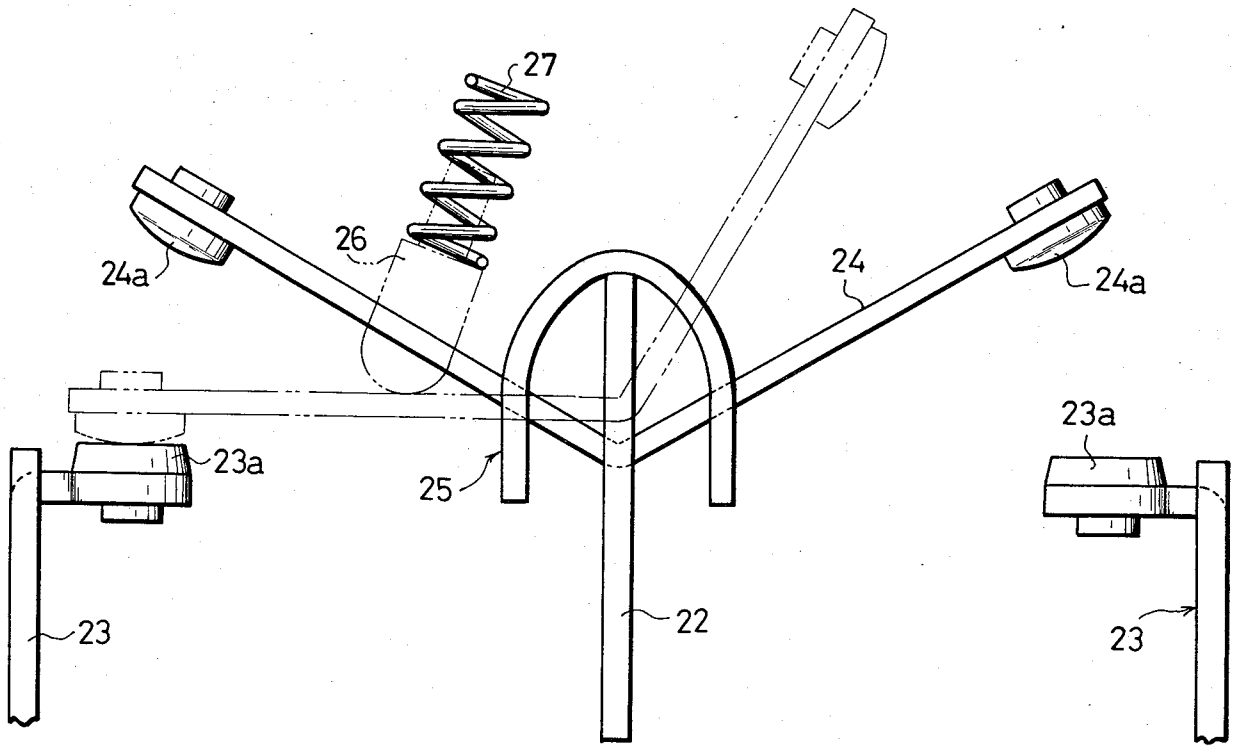

FIGS. 2 to 4 are explanatory views of a seesaw switch according to the present invention, in which FIG. 2 is a view of the contact structure of the seesaw switch, FIG.3 is an exploded perspective view of the essential portions thereof and FIG. 4 is a view for explaining the operation thereof.

Figure 1:
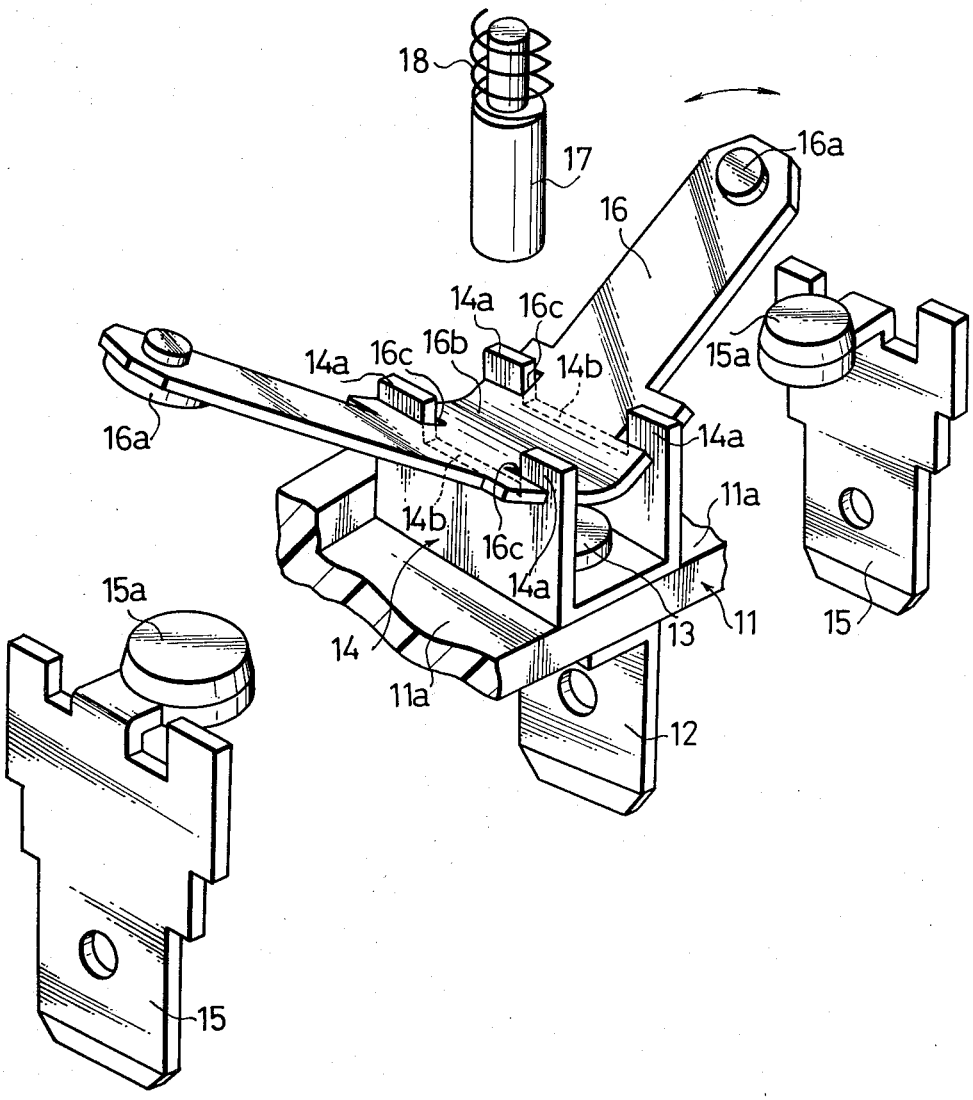
Fig.1 PRIOR ART
FIG. 1 is a view for explaining the contact structure of a known seesaw switch.

In the figures, numeral 21 designates a casing of the switch, which is partly broken away in the illustration. A middle terminal 22 is planted and fixed in the middle part of the inner bottom surface 21*a* of the casing 21, and stationary terminals 23 each having stationary contact 23*a* are similarly planted and fixed on respective sides of the casing. The middle parts of opposing inner side walls 21*b* are formed with grooves 21*c* which extend to the inner bottom surface 21*a* in parallel with each other so as to locate the middle terminal 22 at their central position. A broad notch 22*b* is provided in the middle part of the upper end part 22*a* of the middle terminal 22, as shown in FIG. 3. Numeral 24 indicates a movable contact piece which is provided with contact portions 24*a* at its respective ends and which is formed generally in the shape of the letter V. In the middle part of the movable contact piece 24, four engaging pieces 24*c* protruding laterally outwards are formed. Numeral 25 indicates a receiver for the movable contact piece which is formed by punching a rectangular hole in the central part of a conductive metal plate and thereafter bending the plate substantially into the shape of the letter U. It thus has a cutaway portion 25*a* and top portions 25*b*. The widthwise dimension A, as shown in FIG. 3, of the cutaway portion 25*a* is made somewhat greater than that A' of the middel part 24*b* of the movable contact piece 24, and the width B when bent is made somewhat greater than the spacing B' of the engaging pieces 24*c* of the movable contact piece 24. More precisely, the bent shape of the receiver 25 consists of straight portions 25*c* extending downwardly and whose free ends are parallel to each other, and arcuate portions 25*d* whose diameters are equal to the bending width B. Numeral 26 deignates a driving rod, and numeral 27 a coiled spring, these parts having the same construction as for the switch illustrated in FIG. 1.

Now, there will be described the assemblage of the seesaw switch according to the present invention.

First, receiver 25 is fitted into the grooves 21*c* formed in the inner sides walls 21*b* of the casing, while simultaneously placing it on the upper end part 22*a* of the middle terminal 22 fixed to the casing 21. The receiver 25 is formed in advance to a height dimension which is smaller than the protruding height from the inner bottom surface 21*a* to the upper end part 22*a* of the middle terminal 22. Accordingly, the movable contact piece receiver 25 is supported inside the top portions 25*b* by the upper end part 22*a* of the middle terminal 22.

Subsequently, the middle portion 24*b* of the movable contact piece 24 is fitted into the cutaway portion 25*a* of the receiver 25 and is thus held for rocking movement.

Lastly, a driving member, not shown, which receives the driving rod 26 through the coiled spring 27 is rockably engaged with the casing 21. Then, the assemblage of the seesaw switch according to the present invention is completed. In bringing the driving member into engagement with the casing 21, the fore end of the driving rod 26 is brought into sliding contact with the rear surface of the middle portion 24*b* of the movable contact piece 24.

There will now be described the switching operation of the seesaw switch according to the present invention.

Under the state under which the driving rod 26 overlies the center of the middle terminal 22 and under which its fore end lies in resilient contact with the facing surface of the middle portion 24*b* of the V-shaped movable contact piece 24, in other words, in the case where the driving rod 26 assume its neutral position, both movable contacts 24*a* are separated form the corresponding stationary contacts 23*a*, as shown in solid line position in FIG. 4.

Figure 5:
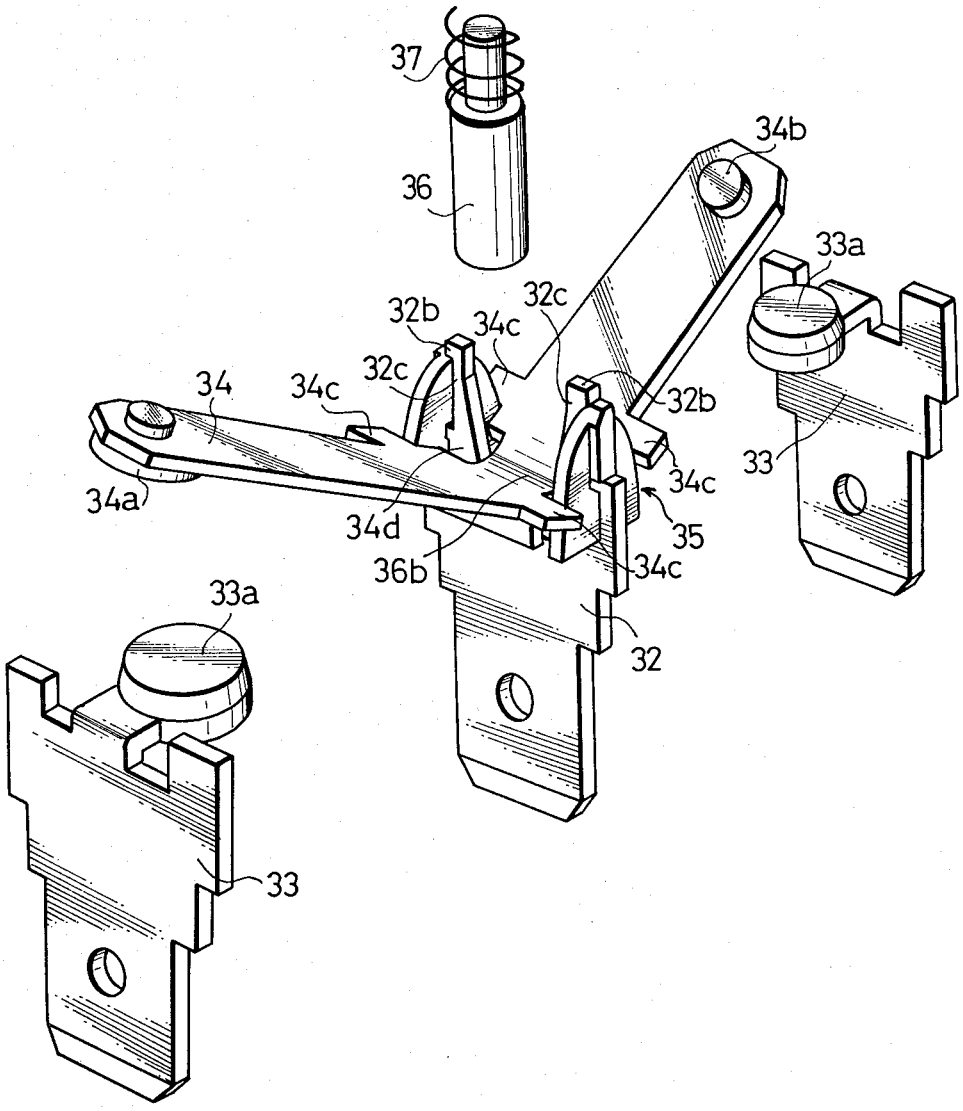
Figure 6:
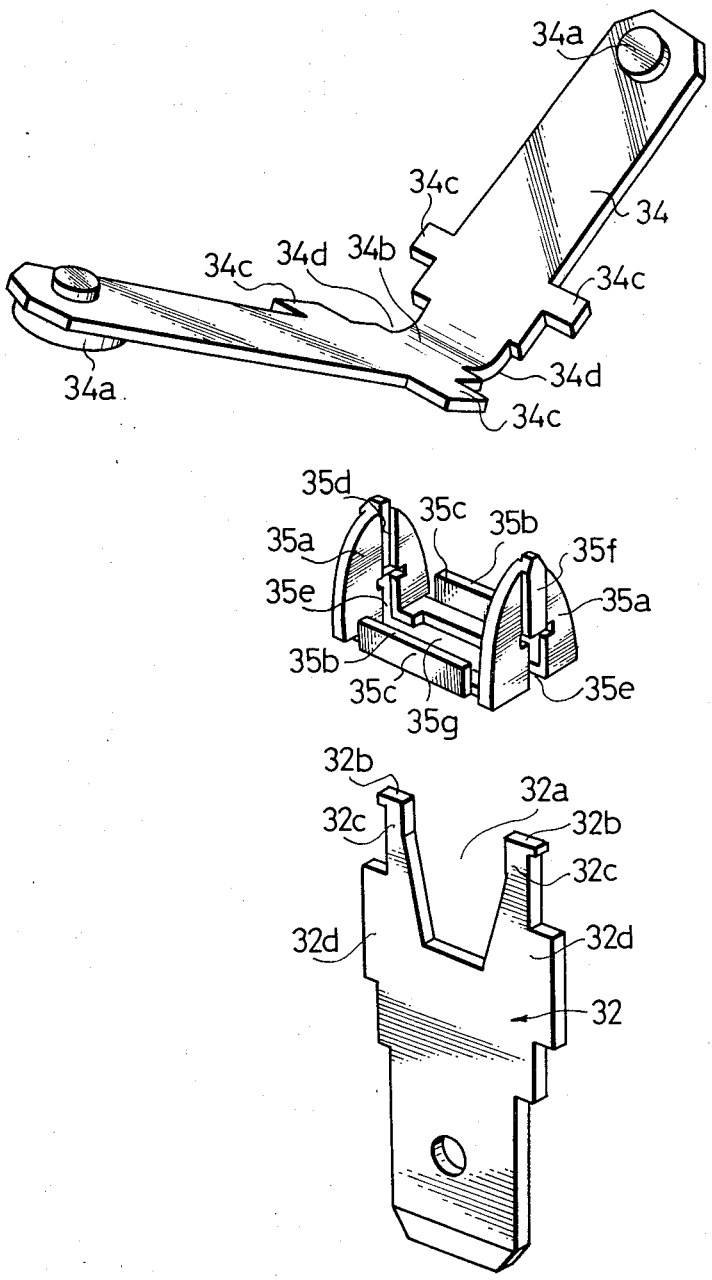

When, under this state, the driving member is rocked against the urging force of the coiled spring 27, the driving rod 26 begins to move rightward or leftward from the neutral position. The moment the fore end of the driving rod 26 has moved passed one side 25*e* of the cutaway portion 25*a* of the receiver 25, the movable contact piece 24 is suddenly inclined with the side 25*e* as a fulcrum by the resilient force of the coiled spring 27, and the respective movable contact 24*a* and stationary contact 23*a* on the inclined side touch to close the switching circuit, as shown in the two-dot chain line in FIG. 4. The movable contact piece 24 turns with the side 25*e* of the cutaway portion 25*a* as a supporting shaft while receiving a force in the moving direction of the driving 26 owing to a friction during the movement of the driving rod 26 against the urging force of the coiled spring 27. Since the arcuate portions 25*d* of the movable contact piece receiver 25 are formed into circular arcs centering around the opposite fulcrum, the movable contact piece 24 is held to the receiver in any position of the inclination by the action between the arcuate portions 25*d* and the engaging pieces 24*c*, that is, it is allowed only to rock, so that the opening and closure of the contacts as prescribed can be performed at all times. As stated above, the engaging pieces 24*c* of the movable contact piece 24 and the arcuate portions 25*d* of the receiver 25 are held in engagement at any position, so that the movable contact piece does not have any play or loosen during operation. FIGS. 5 and 6 are explanatory views for another embodiment of a seesaw switch according to the present invention, in which FIG. 5 is a view of the contact structure of the embodiment and FIG. 6 is an exploded perspective view of the essential portions thereof.

In the figures, numeral 32 designates a middle terminal which is made of a conductive material and which is planted and fixed to a casing not shown. The upper middle part of the middle terminal 32 is formed with a broad notch 32*a*, and is also formed with upper end portions 32*c* which form the notch 32*a* therebetween and which have respective pawl portions 32*b*. Further, projections 32*d* are formed continous to the upper end portions 32*c* so as to extend outwardly from these upper end portions. Numerals 33 indicate stationary terminals, which are planted and fixed at both the ends of the casing and whose heads are formed with respective stationary contacts 33*a*. Numeral 34 indicates a movable contact piece form of a conductive material into the general shape of letter V. Movable contacts 34*a* are formed on respective ends of the movable contact piece, and four engaging pieces 34*c* are formed on opposite sides of a bent portion 34*b*. Notches 34*d* are formed inwardly of the bent portion 34*b*.

Numeral 35 indicates a conductive receiver, which is formed by punching a flat metal plate and thereafter bending the plate. The receiver 35 includes a pair of arcuate guide portions 35*a* which rise from the base part thereof and which guide the engaging pieces 34*c* of the movable contact piece 34, movable contact piece-supporting portions 35*c* which support the movable contact piece 34 in a rockable fashion and which have straight portions 35*b* serving as the fulcrums for the rocking of the movable contact piece, grooves 35*d* which are formed on the inner sides of the guide portions 35*a*, notches 35*e* which are formed in the guide portions 35*a* and which are continuous to the grooves 35*d*, protuberant portions 35*f* which are formed on the opposite surfaces to the grooves 35*d*, and a punched opening 35*g*. Numeral 36 represents a driving rod and numeral 37 a coiled spring, which have the same constructions and functions as those of the driving rod 26 and the coiled spring 27 shown in FIG. 2, respectively.

As regards the assemblage of the seesaw switch of FIG. 5 and the middle terminal 32 with the upper end portions 32*c* of the middle terminal 32 being brought into engagement with the grroves 35*d*. In the state in which the receiver 35 is fitted held to the casing. In the state in which the receiver 35 is fitted in the middle terminal 32, the pawl portions 32*b* are engaged with the top parts of the guide portions 35*a*, and the projections 32*d* formed at respective ends of the middle terminal 32 are supported in engagement with the notches 35*e*.

Subsequently, the movable contact piece 34 is placed so that the bent portion 34*b* may lie in an area surrounded by the guide portions 35*a* and the movable contact piece-supporting portions 35*c* of the receiver 35. At this time, the movable contact piece 34 us supported by the straight portions 35*b* of the movable contact piece-supporting portions 35*c*.

Lastly, a driving member, not shown, which received the driving rod 36 through the coiled spring 37 is rockably engaged with the casing. Then, the seesaw switch according to the present invention is completed. In bringing the driving member into engagement with the casing, the fore end of the driving rod 36 is brought into sliding contact with the facing surface of the movable contact piece 34.

In the switching operation, when the driving member is rocked, the fore end of the driving rod 36 moves rightward or leftward from its neutral position as in the seesaw switch of FIG. 2. The moment the fore end has passed the straight portion 35*b*, the movable contact piece 34 is suddenly inclined with the straight portion 35*b* as a turning fulcrum by the resilient force of the coiled spring 37, and the switching operation is made. In the switching operation, the engaging pieces 34*c* of the movable contact piece 34 move smoothly along the arcuate outer peripheries of the guide portions 35*a*, so that the closure or opening of the contacts as prescribed is performed at all times. Since the engaging pieces 34*c* of the movable contact piece 34 and the guide portions 35*a* are held in engagement at any position, the movable contact piece does not have any play and is held securely during operation. Further, since the arcuate portions of the guide portions 35*a* and the straight portions 35*b* of the guide supporting portions 35*c* can be formed by cutting independently of each other in advance, the dimensional accuracies of the straight line and the circular arc can be made high. In addition, since the receiver 35 and the middle terminal 32 are fixed by holding the upper end portions 32*c* of the latter in engagement with the grooves 35*d* of the former, the electrical stability is high.

As set forth above, according to the present invention, the movable contact piece does not loosen or have much play during switching operation, and it moves smoothly along the arcuate outer peripheries, so that the prescribed closure or opening of the contacts can be performed at all times. Further, according to the present invention, the movable contact piece can move smoothly even when the clearances between the movable contact piece and the movable contact piece receiver are not made great, and the movable contact piece does not easily become loosened.

I claim:

1. In a switch having a central terminal, stationary terminals disposed on respective sides of the central terminal, and a movable contact piece placed over the central terminal, the movable contact piece being movable pivotally so as to connect or disconnect the central terminal and a corresponding stationary terminal, the improvement wherein a receiver for the movable contact piece is provided with means including arcuate guide portions extending upwardly from opposite sides of said movable contact piece for supporting said movable contact piece against lateral movement during its pivotal movement, and said movable contact piece including engaging means adapted to ride along said arcuate guide portions whereby said guide portions serve to support said movable contact piece laterally while providing a arcuate guide for supporting said movable contact during its entire range of movement.

2. A switch according to claim 1, wherein said receiver is formed by bending a metallic plate into the shape of the letter U, said metal plate having a quadrilateral hole and being placed on said middle terminal, and a middle part of said movable contact piece being located in the hole of said receiver.

3. A switch according to claim 2, wherein said engaging means includes four engaging pieces adapted to come into sliding contact with the arcuate guide parts of said receiver.

4. A switch according to claim 1, wherein said receiver includes a pair of arcuate guide parts rising from its base part and is placed on said middle terminal, a a middle part of said movable contact piece is located between said pair of arcuate guide portions of said receiver.

5. A switch according to claim 4, wherein said engaging means includes four engaging pieces adapted to come into sliding contact with said arcuate guide portions of said receiver.

* * * * *